US009945560B1

(12) United States Patent
Rzonca

(10) Patent No.: US 9,945,560 B1
(45) Date of Patent: Apr. 17, 2018

(54) FIRE STARTER APPARATUS

(71) Applicant: Paul Michael Rzonca, Veneta, OR (US)

(72) Inventor: Paul Michael Rzonca, Veneta, OR (US)

( * ) Notice: Subject to any disclaimer, the term of this patent is extended or adjusted under 35 U.S.C. 154(b) by 388 days.

(21) Appl. No.: 14/672,203

(22) Filed: Mar. 29, 2015

(51) Int. Cl.
*F23Q 2/18* (2006.01)
*F23Q 11/08* (2006.01)
*F23Q 1/06* (2006.01)
*F23B 20/00* (2006.01)

(52) U.S. Cl.
CPC ..... *F23Q 11/08* (2013.01); *F23Q 1/06* (2013.01); *F23B 20/00* (2013.01)

(58) Field of Classification Search
CPC ..... F23Q 2/24; F23Q 1/06; F23Q 1/04; F23B 10/00; F23B 20/00
USPC ..... 126/25 B; 116/DIG. 40
See application file for complete search history.

(56) References Cited

U.S. PATENT DOCUMENTS 2,243,924 A * 6/1941 Schmitt ..... F23Q 2/30 131/329
2,384,278 A * 9/1945 Caldwell ..... A47J 36/30 126/263.01
2,445,890 A * 7/1948 Schmitt ..... F23Q 2/30 206/0.7
2,548,379 A * 4/1951 Lammersen ..... C10L 5/44 126/25 B
2,721,558 A * 10/1955 Griffiths ..... A24D 1/08 131/351
2,738,260 A * 3/1956 Wolfson ..... C10L 11/04 126/25 B
2,760,364 A * 8/1956 D'Alton ..... F23Q 2/18 431/252
2,789,501 A * 4/1957 Sawicki ..... B63B 51/04 102/257
2,909,914 A * 10/1959 Vissing ..... F23Q 2/24 431/272
3,031,870 A * 5/1962 Markus-Markush ..... F23Q 2/30 431/127
4,013,061 A * 3/1977 Trumble ..... C06B 45/12 102/202.5
4,487,572 A * 12/1984 Parker ..... F23Q 13/04 126/25 B
4,698,068 A * 10/1987 Jensen ..... C10L 11/00 431/269
4,953,533 A * 9/1990 Witt ..... A47J 37/0768 126/25 B
5,220,908 A * 6/1993 Iizuna ..... A47J 36/30 126/262
5,299,556 A * 4/1994 Ando ..... A47J 36/30 126/261
5,626,022 A * 5/1997 Scudder ..... A47J 36/28 126/263.01

(Continued)

*Primary Examiner* — Gregory Huson
*Assistant Examiner* — Martha Becton
(74) *Attorney, Agent, or Firm* — Paul Michael Rzonca

(57) ABSTRACT

This embodiment relates generally to the Fire-Starter Apparatus (200) as a means to provide an instant fire in a safe, portable, time-saving, disposable, and convenient manner. The Fire-Starter Apparatus (200) contains both the fuel and reagents housed in a safe and convenient manner. The Fire-Starter Apparatus (200) relies on the user to cause the separated reagents to admix together, causing an exothermic reaction between reagents as a result of a chemical reaction between reagents.

20 Claims, 3 Drawing Sheets

(56) References Cited

U.S. PATENT DOCUMENTS

| | | | | |
|---|---|---|---|---|
| 5,743,248 | A * | 4/1998 | Jansen, Jr. | C10L 11/04 126/25 B |
| 5,967,769 | A * | 10/1999 | Thompson | C10L 5/40 126/25 B |
| 6,099,806 | A * | 8/2000 | Cortellucci | A62B 21/00 422/120 |
| 6,141,970 | A * | 11/2000 | Molzahn | A23G 9/00 126/263.01 |
| 6,178,753 | B1 * | 1/2001 | Scudder | A47J 36/28 126/263.08 |
| 6,267,110 | B1 | 7/2001 | Tenemboum et al. | |
| 6,986,345 | B2 * | 1/2006 | Kolb | A23L 3/02 126/263.08 |
| 7,350,362 | B2 * | 4/2008 | Danwoody | A47J 36/28 126/263.06 |
| 8,092,623 | B1 * | 1/2012 | Cramer | C06B 33/00 149/108.2 |
| 9,055,841 | B2 * | 6/2015 | Coffey | A47J 36/28 |
| 2004/0234914 | A1 * | 11/2004 | Hale | A61M 11/041 431/269 |
| 2005/0139205 | A1 * | 6/2005 | Paez | A47J 37/079 126/25 B |
| 2007/0042306 | A1 * | 2/2007 | Bacon | E21B 36/02 431/268 |
| 2010/0252023 | A1 | 10/2010 | Coffey et al. | |
| 2015/0335064 | A1 * | 11/2015 | Abisdid | A24D 1/08 131/350 |

* cited by examiner

View A-A

View A-A

FIRE STARTER APPARATUS

CROSS REFERENCE TO RELATED APPLICATIONS

This Non Provisional Application is a continuation of, and carries the benefits of the earlier filing of, a Provisional Application 61/972,347 filed on Mar. 30, 2014.

BACKGROUND—PRIOR ART FOR DISBURSEMENT APPARATUS

The following is a tabulation of some prior art that presently appears relevant:

| U.S. Pat. | | | |
|---|---|---|---|
| Pat. No. | Kind Code | Issue Date | Patentee |
| No. U.S. 6,062,142 | | May 16, 2000 | Atlantic Research Corp. |
| No. U.S. 6,267,110 | | Jul. 31, 2001 | Convenience Heating Tech. LTD |
| No. 20080115409 | | May 22, 2008 | Tran Bo L |
| No. 20090025276 | | Jan. 29, 2009 | Tran Bo L |
| Non Patent LiteratureDocuments | | | |
| None | | | |

Fire has been an age's long requirement for comfort, safety, and security since the beginning of civilization. Earlier form of fire-starters has been in the form of converting a mechanical motion into heat generated by friction. Such examples are two flint stones striking each other, a fire bow drill whereby a stick is rotated rapidly in a hole using the bow to rotate it, and the modem matches. However, none of these mechanical motions would produce the necessary sparks or heat if friction was absent or was severely compromised. This friction based form of combustion, or more specifically the right level of Coefficient of Friction of two contacting surfaces, may not be available in the extreme environment the fire is being produced in, such as in high humidity places. Thus a self-contained fire-starter that bypasses the need for friction, that has almost all the necessary conditions for fire-starting, that has all these conditions contained in a portable unit that permits a long shelf life, is more conducive for fire-starting under unfavorable conditions.

One of the most visible forms of portable fire-starters bypassing friction is the chemical reaction between reagents. This chemical reaction is exothermic, providing sufficient heat release to raise the temperature of the exothermic activity so as to combust the fuel in the reagents and/or ancillary fuel adjacent to the exothermic activity.

It is common for exothermic reaction based fire to use a first group of reagents that includes at least one compound selected from the group consisting of potassium permanganate, manganese oxide, potassium chlorate, barium peroxide and potassium nitrate. It is also common to exothermically pair this first group of reagent with a second group of reagent that includes at least one compound selected from the group consisting of ethanol, isopropanol, ethylene glycol and polyethylene glycol. When these two groups of reagents are in admixed with each other, they produce an exothermic reaction releasing sufficient energy to combust the reagents themselves and/or ancillary fuel adjacent to the exothermic activity.

It is from this spontaneous and volatile nature of combustion that creates the challenge to keep these two groups of reagents safely, properly, and conveniently housed close to—but separate from—each other, ensuring the absence of an accidental activation of the exothermic reaction; to provide a quick, portable, and inexpensive means to selectively admix them; and to ensure the byproducts of such combustion will not limit or impede the use of this combination in a narrow and restricted way. This challenge is further made bigger by the fact that the first group of reagents is granular and amorphous in nature, that it is a powerful oxidant that is harmful for human contact, and that its potency is rendered useless when wet. Additional challenges appear when the second group of reagents is liquid in nature, requiring a non permeable membrane or container to prevent accidental admixing/combustion.

Aside from the safety considerations above, there has been an increasing appeal to have a self-contained fire-starter that is inexpensive enough to be used in starting a cooking grill, in starting recreational campfires, and even in providing instant fire for survivalist training/kits. This growing ubiquitous application for such tire-starter places a high premium for it to be produced inexpensively, with high portability, of high shelf life, of high reliability, and with as little intrusive by products that would deter its use:—all this while having a quick and uncomplicated means to start a fire instantly on demand.

In reference to a FIG. 7 embodiment as shown in Patent US 2010/0252023 A1 issued on Oct. 7, 2010 to Coffey et al, this embodiment does not meet the challenges of reliability, cost effectiveness, and of the difficult handling nature of the glycerin during its introduction into the device. It fails to properly avoid any accidental exothermic admixing of the reagents as the integrated piercing member 750 is placed over the entire system, putting the piercing member directly in line with the pathway that allows this admixing. This direct line of fire thus must heavily rely on the stiffness of the malleable material cover 760 to prevent this accidental admixing. But this stiffness-in-the-name-of-safety cover property is coupled to—in a way that also opposes—the ease in which the user can selectively deform the cover in order for the plunger to pierce the barrier 730. In short, Reliability and Ease of Admixing competes directly with each other.

Also in reference to the above FIG. 7 embodiment, the difficult handling nature of glycerin is not addressed. Glycerin is liquid in nature and is prone to leak where there is a micro breach in containing it. The FIG. 7 embodiment does not provide any multi-barrier insurance in the event the single foil seal that separates the reagents is compromised during the assembly package or during the settling nature post assembly.

Additionally, the amorphous form of a liquid requires the barrier walls to be in place so as to contain the liquid glycerin during assembly. It is to my best understanding that during the deformation of the dome, the interior space in which the glycerin resides is reduced, causing a rise in internal pressure. This increase in pressure places additional stress to the foil sealant as well as to the dome sealing to the cylinder walls. This pressure increase can also be due to changes in storage temperature. Hence, the accidental admixing of the reagents can happen by the accidental deformation of the dome during handling as well as changes in storage temperature. Any avoidance of these accidental causal factors drives up the cost of the sealant design and manufacturing, as well as the cost to test their performance within an acceptable operating range. The cost of liability avoidance has just increased due to this complication.

In summary, FIG. 7 embodiment works well on paper but not in real life for it relies heavily on a single seal barrier, rather than a multi barrier seal, to prevent accidental admixing; it has only one last defense, versus multiple defenses, that can be easily and accidentally defeated when the piercing member is in line with the piercing path that pierces the seal; the sealing chamber for the glycerin is prone to leaks caused by an accidental deformation of the dome and by uncontrollable changes in the storage temperature; and the stiffness of the malleable cover stiff enough to prevent any accidental deformation would oppose the ease of piercing the foil barrier.

In reference to the embodiment of FIG. 2C of U.S. Pat. No. 6,267,110 BI issued to Tenenboum on Jul. 31, 2001, Tenenboum employs a different implementation, starting with a liquid reagent contained in storage cell 16 as a foil packet. To provide controlled tearing of the packet on demand, foil packet 16 encloses a specially formed spring element 46. As best seen in FIG. 2C, spring element 46 is formed with a piercing element 48 and a number of resilient spacers 50 biased to a position in spaced relation to piercing element 48. In a normal un-flexed state of spring element 46, resilient spacers 50 prevent contact between piercing element 48 and foil packet 16. When force is applied through one surface of foil packet 16, spring element 46 is deformed such that piercing element 48 comes into contact with the opposite surface of foil packet 16 so as to tear open the foil packet and release the liquid reagent onto the first reagent in second region 14. Here too, the force required for actuation is preferably provided by relative movement of heating unit 10 relative to container 18.

Tenenboum's art again suffers the same reliability and cost effectiveness problems as in Coffey. With respect to reliability, the only last line of defense preventing accidental admixing of the reagents is in the prevention of heating unit 10 relative movement to container 18. That is because the piercing element 48 is in a biased space relation to the foil packet containing the liquid reagent. However, an accidental movement of heating unit 10 relative to container 18 removes this biased space, causing the unintended admixing of the reagent. A prevention of this would require a locking and confirmation device that user wants to move heating unit 10 relative to container 18. This drives the design to be more complicated and costly, which is already driven up by the spring element and the plurality of dividing walls and devices to perform selective communication between reagents.

Advantages

Accordingly, several advantages of one or more aspects are as follows: to have a fire-starter device that is inexpensive to produce, that has a preventive mechanism that is not easily and accidentally defeated so as to cause an accidental admixing of reagents, that avoids a reliability and design cost increase due to inadvertent user handling and user storage temperature changes, that has a design whereby the admixing of reagents does not require additional work to defeat preventive mechanisms, that has a simple and reliable means of handling the reagents in assembling the apparatus, that has a simple and reliable means of assembling the reagents in a selectively communicative way, and that is portable.

DRAWINGS—FIGURES

Notice: A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Alternate Embodiments

Figure 5:
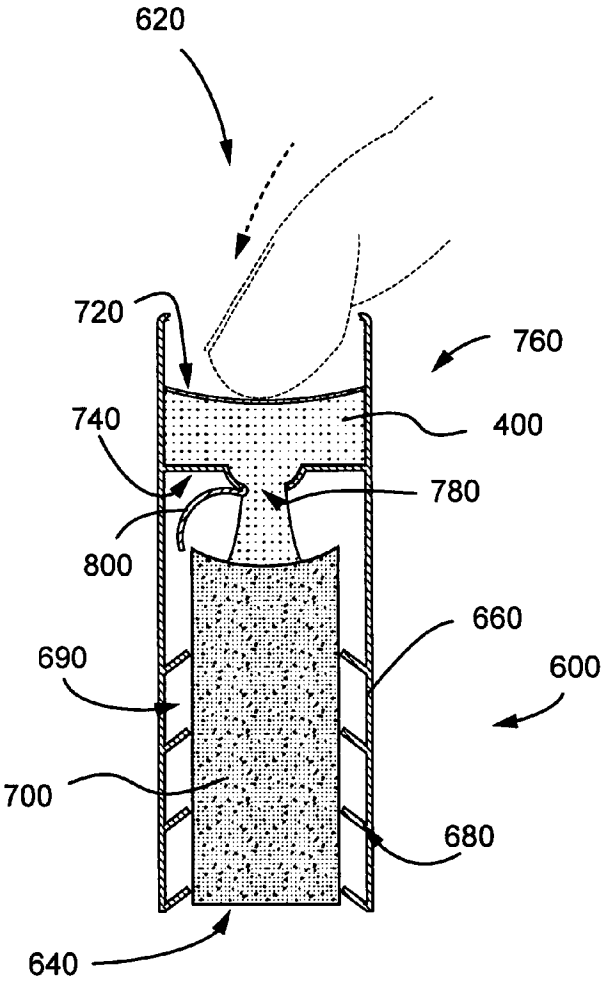
Figure 4:
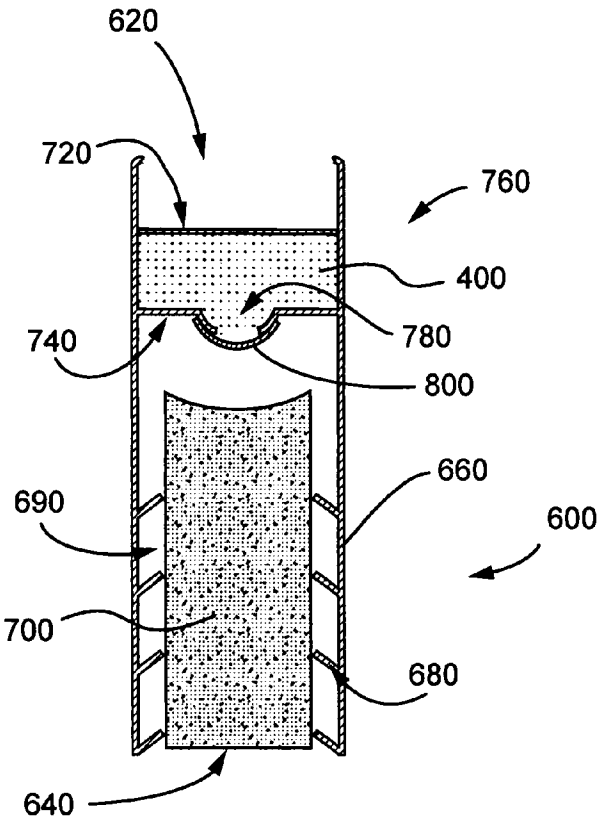

FIG. 4 illustrates a Section A-A view of the Fire-Starter apparatus of the alternative embodiment;

FIG. 5 illustrates a Section A-A view of the Fire-Starter apparatus of the alternative embodiment during operations;

DRAWINGS—REFERENCE NUMERALS

| | | | |
|---|---|---|---|
| 200 | Fire-Starter Apparatus | 220 | First end |
| 240 | Second End | 260 | Cylinder |
| 280 | Integrated annular ring | 300 | Top Plug |
| 120 | Bottom Plug | 340 | First reservoir |
| 360 | Second Reservoir | 380 | Opening |
| 400 | First reagent | 420 | First encapsulating barrier |
| 440 | Second reagent | 460 | Second encapsulating barrier |
| 480 | Piercing member | 500 | Urging end |
| 520 | Piercing end | | |
| 600 | $2^{nd}$ apparatus | 620 | $2^{nd}$ first end |
| 640 | $2^{nd}$ second end | 660 | $2^{nd}$ cylinder |
| 680 | Annular ring | 690 | Initiation region |
| 720 | First membrane | 700 | Reagent plug |
| 760 | $2^{nd}$ first reservoir | 740 | Barrier |
| 800 | Plug | 780 | Hole feature |

SUMMARY: EMBODIMENTS

Embodiments of the approaches described herein provide an apparatus comprising: a housing configured to have a first end and a second end, a storage cell, an initiation region, an annular ring; a first reagent; a second reagent; a removable barrier interposed between the at least first reagent and the at least second reagent in a selective manner; wherein the at least first reagent is housed in the storage cell; wherein the annular ring prevents the at least second reagent in the initiation region from moving; wherein the initiation region houses the at least a second reagent adjacent to the at least first reagent; wherein both the storage cell and initiation region are in continuous communication with each other in a selective and thermal communicative way; whereby upon user's urging, the barrier is removed from its interposed position and the at least first reagent evacuates from the storage cell into the initiation region, bringing the at least first reagent into contact with the at least second reagent, resulting in a contact that causes both the at least reagents to undergo a spontaneous exothermic chemical reaction thereby initiating said exothermic chemical reaction of said reagents.

Optionally, the annular ring circumscribes the interior wall of the housing in a sealable manner, wherein the annular ring embraces the second reagent in a continuously embracing and sealing manner.

Optionally, the storage cell comprises a first and second wall, wherein the first wall of the storage cell is defined by a malleable membrane that fully circumscribes and joins the interior wall of the housing in a sealing manner, and wherein the membrane is sufficiently offset from the first end whereby to prevent unintended user contact with malleable membrane.

Optionally, wherein the second wall of the storage cell is defined by a non-movable barrier comprising a hole feature, wherein the non-movable barrier fully circumscribes the interior wall of the housing in a sealing manner, and whereby the storage cell completely houses the first reagent in a selectively sealable manner when used in conjunction with the removable barrier and with the interior wall of the housing.

Optionally, the malleable membrane and the removable barrier is in continuous communication with each other.

Optionally, the first reagent is a compound selected from a group comprising of ethanol, isopropanol, ethylene glycol and polyethylene glycol.

Optionally, the second reagent is a compound selected from a group comprising of potassium permanganate, manganese oxide, potassium chlorate, barium peroxide and potassium nitrate.

Optionally, the second reagent is admixed with a combustible material to form a plug.

Optionally, the second reagent has a shape that is slightly larger than the interior diameter of the annular ring so as to whereby achieve a seal that prevents the second reagent from moving within the housing and that prevents any first reagent leaks while in the initiation region.

Optionally, the removable barrier comprises of a contiguous membrane that fully encapsulates the first reagent in a fully sealable manner.

Optionally, the housing terminates with the annular ring at the first end and a second annular ring at the second end.

Optionally, the apparatus further comprises a first plug made from a combustible material, wherein the plug substantially conforms to the interior walls of the housing, wherein the external size of the plug exceeds the inside size of the annular ring, wherein the plug is interposed between the annular ring and the first reagent, whereby the first reagent is trapped from exiting the first end of the housing by the first plug.

Optionally, the second reagent is a plug that is interposed between the first reagent and the second annular ring at the second end.

Optionally, the first plug comprises of a tunnel feature that permits access to the first reagent.

Optionally, the apparatus further comprises a piercing member with an urging end and a piercing end, wherein a user urges the piercing member into the tunnel feature, and selectively removes the contiguous membrane of the at least first reagent by urging the piercing member using the urging end to pierce the contiguous membrane with the piercing end of the piercing member, whereby bringing the at least first reagent into contact with the at least second reagent, a contact that causes both the at least reagents to undergo a spontaneous exothermic chemical reaction, thereby initiating said exothermic chemical reaction of said reagents and said plugs.

Optionally, the apparatus further comprises a second plug made from a combustible material, wherein the plug substantially conforms to the interior walls of the housing, wherein the external size of the plug exceeds the inside size of the annular ring, wherein the plug is interposed between the second annular ring and the second reagent, whereby the second reagent is trapped from exiting the second end of the housing by the second plug.

Optionally, the apparatus further comprises a second removable barrier, wherein the second removable barrier comprises of a second contiguous membrane that fully encapsulates the second reagent in a fully sealable manner.

Optionally, a user urges the piercing member into the tunnel feature, and selectively removes both the contiguous membrane and second contiguous membrane by urging the piercing member via the urging end to pierce both membranes with the piercing end of the piercing member, whereby bringing the at least first reagent into contact with the at least second reagent, a contact that causes both the at least reagents to undergo a spontaneous exothermic chemical reaction, thereby initiating said exothermic chemical reaction of said reagents and said plugs.

Figure 1:
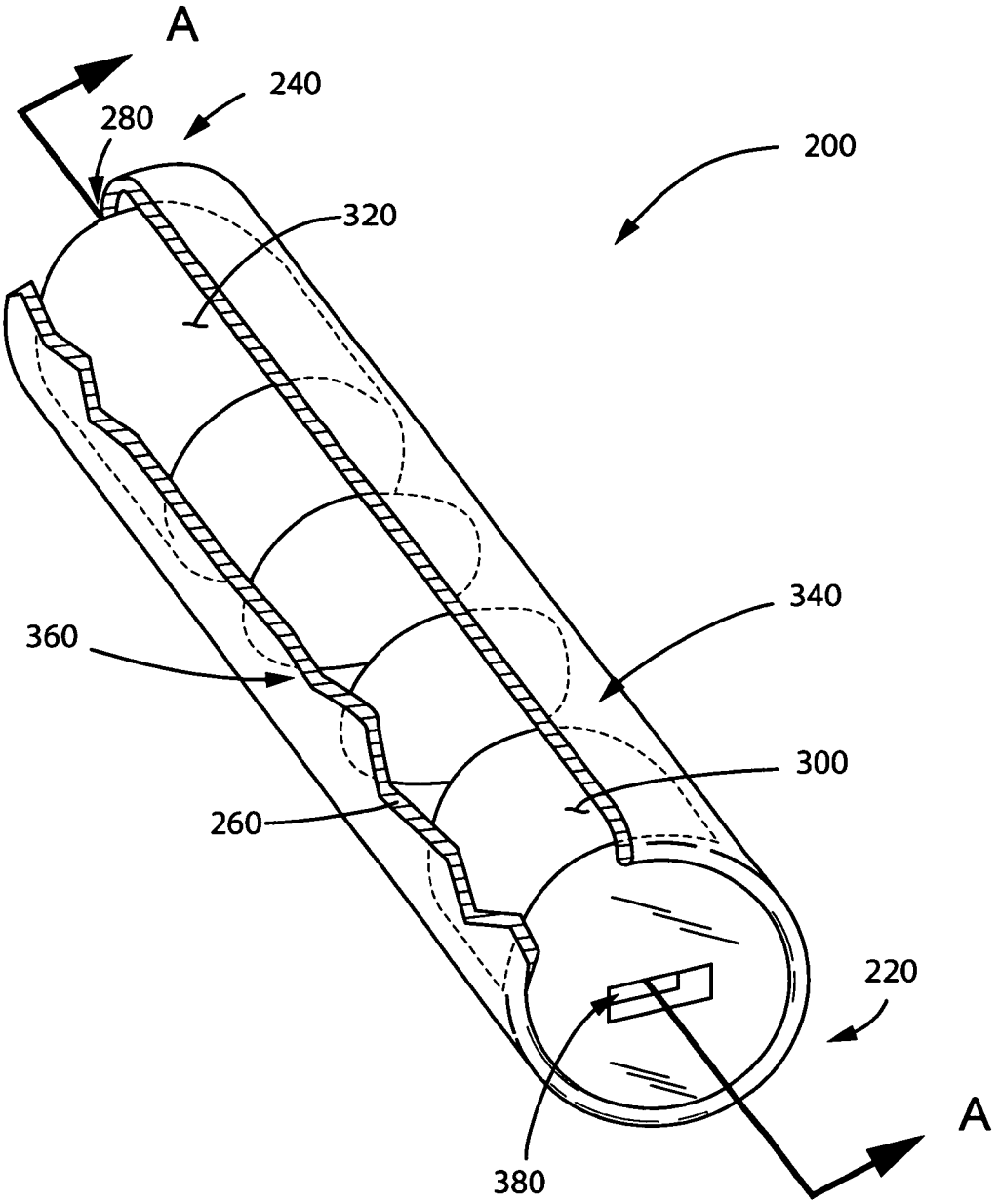
FIG. 1 illustrates a perspective view of the Fire-Starter apparatus of the present invention, shown with a cut out section to reveal the interior contents.
Figure 2:
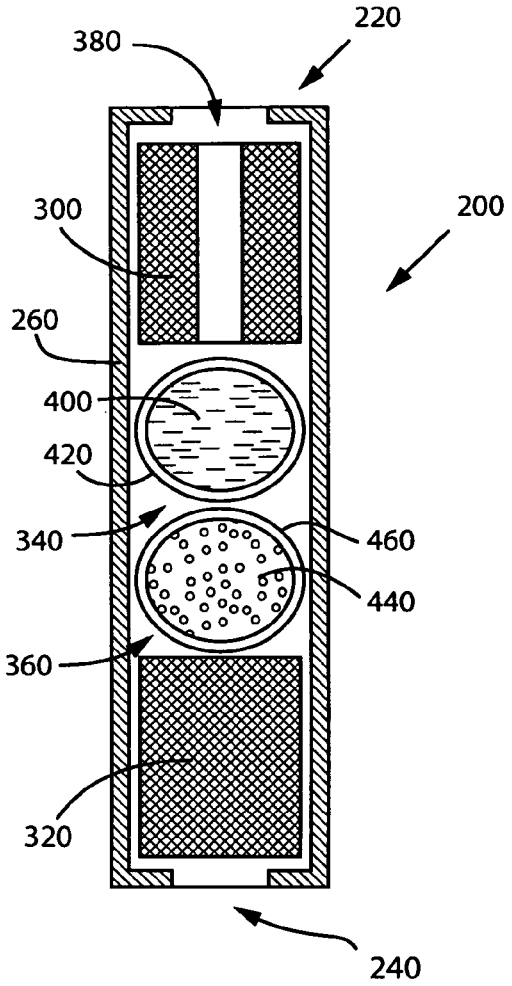
FIG. 2 illustrates a Section A-A view of Fire-Starter apparatus of the present invention prior to any admixing of reagents.
Figure 3:
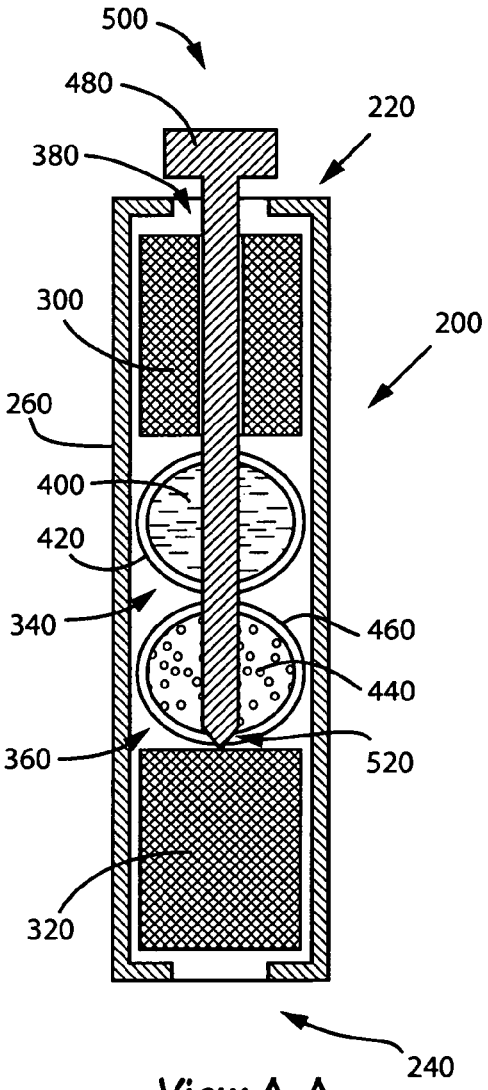
FIG. 3 illustrates a Section A-A view of Fire-Starter apparatus of the present invention showing a Piercing member admixing the reagents.

Detailed Description: First Embodiment—Fire Starter Apparatus. FIGS. 1-3

While the configurations according to the illustrated embodiment are preferred, it is envisioned that alternate configurations of the present invention may be adopted without deviating from the invention as portrayed.

The preferred embodiments are discussed hereafter.

Referring first to FIG. 1, a perspective view of a Fire-Starter Apparatus 200 is shown with a diagrammatically cutout section, a section that is only illustrated to reveal the interior contents for clarity sake. The apparatus 200 comprise of two ends, a first end 220 and a second end 240. The preferred shape of the apparatus 200 is a cylinder 260 having a longitudinal axis that connects the first and second ends 220 and 240 through their centers. The cylinder 260 terminate at both first and second ends 220 and 240 with a integrated annular ring 280 whose interior diameter is less than the interior diameter of the cylinder 260. The purpose of this ring 280 is to ensure the contents within the cylinder 260 interior space stays there during handling and during operations.

Referring to FIGS. 1 and 2, the apparatus 200 comprises of cylinder 260, having stacked in it a top plug 300 at first end 220, a bottom plug 320 at second end 240, a first reservoir 340 and a second reservoir 360 adjacent to each other in between both plugs 300 and 320. It is currently contemplated that plugs 300 and 320 are made of a combustible material, such as compressed wood material, so they can also assist in the fire-starting process. It is also currently contemplated that the plugs 300 and 320 are substantially wide enough to fill in the interior diameter of the cylinder 260, making them substantially cylindrical in geometry.

Referring to FIGS. 1 and 2, the top plug 300 comprise of an opening 380 located substantially about its longitudinal center. This opening 380 projects throughout the longitudinal length of the plug 300 in a manner that is substantially parallel to the longitudinal axis of the cylinder 260.

Referring to FIG. 2, the first reservoir 340 comprises a first reagent 400 fully encapsulated by a first encapsulating barrier 420. The second reservoir 360 comprises a second reagent 440 fully encapsulated by a second encapsulating barrier 460. It is currently contemplated that the first reagent 400 includes at least one compound selected from the group consisting of potassium permanganate, manganese oxide, potassium chlorate, barium peroxide and potassium nitrate. It is also currently contemplated that the second reagent 440 includes at least one compound selected from the group consisting of ethanol, isopropanol, ethylene glycol and polyethylene glycol. It is also currently contemplated that the first and second encapsulating barrier 420 and 460 comprise of a film strong enough to withstand any user handling and environmental variances without bursting or reacting with their respective reagents, but still pierce-able in a selective manner.

Referring to FIG. 3, in which a piercing member 480 is introduced into FIG. 2, this member 480 comprises of an urging end 500 as well as a piercing end 520. The member 480 in its inactive state resides outside of and adjacent to cylinder 260 (not shown). The member 480 is currently contemplated to comprise of a combustible material with a cross section stiff enough to pierce the encapsulating barriers 420 and 460.

It is currently contemplated the option of having the second reagent 440 be combined with the bottom plug 320 to be one element. This would eliminate the need for second encapsulating barrier 460 as the second reagent 440 would have a more defined form than its previous amorphous form.

Operation: FIG. 3.

With reference to FIG. 3, upon a users urging, the piercing member 480 is relocated from its adjacent position to outside of the cylinder 260 to a position above the apparatus 200. The piercing end 520 is aligned to the opening 380 that allows the user to selectively urge the member 480 into the cylinder 260. Upon user's urging by pushing down on urging end 500, the member 480 is substantially guided by the opening 380 in the manner that pierces both the encapsulating barriers 420 and 460 substantially through their centers. Because it is currently contemplated that the encapsulating barriers 420 and 460 are flexible and piercable in nature, such as plastic film, the plastic film will tear and deform away from the piercing member 480. This creates a leakage between the now pierced edges of the encapsulating barrier 420 and the longitudinal wall of the piercing member 480. As a result of the piercing member 480 pushing some of the first reagent 400 out through this leakage area, a pushing of the reagent that is further assisted by gravity, the now leaked out first reagent 400 seeps into a similarly created gap between the pierced edges of the second encapsulated barrier 460 and the piercing member 460. This then results in an admixing of both reagents 440 and 460 together to produce an exothermic chemical reaction. The piercing member 480 is then left in this position, and the entire apparatus 200 with the piercing member 480 in it is then placed at a user defined location for the combustion to fully actualize.

Description—Alternative Embodiment FIG. 4

With reference to FIG. 4, the method in which the reagents are housed, separated, and can be selectively and chemically combined with each other require less elements than the method contemplated for the main embodiment.

Referring first to FIG. 4, a cross sectional view of the alternative embodiment is present using the same perspective as in A-A for the main embodiment. This view A-A is to reveal the interior contents for clarity sake.

The alternative embodiment is currently contemplated of comprising of only FOUR (4) elements as such:

The 2nd apparatus 600 comprises of two ends, a 2nd first end 620 and a 2nd second end 640. The preferred shape of the 2nd apparatus 600 is a 2nd cylinder 660 having a longitudinal axis that connects the 2nd first and 2nd second ends 620 and 640 through their centers. The 2nd cylinder 660 contains a plurality of integrated annular ring 680 whose inner diameter is less than the interior diameter of the cylinder 660. The annular ring 680 are pointed in the direction going from the 2nd second end 640 to the 2nd first end 620, giving it a One-Way rib in the cross section view A-A. The purpose of the annular ring 680 is to ensure inserted contents within the interior space of the 2nd cylinder 660 stays there during handling and during operations, with a plurality of annular rings providing added insurance and a leak free seal.

Referring to FIGS. 1 and 4, the 2nd apparatus 600 comprises of a 2nd cylinder 660, having an Initiation Region 690 that has a stacked inside it Reagent Plug 700 inserted from the opening at the 2nd second end 640. It is currently contemplated that this reagent plug 700 is solid and is formed from an admixing of both the reagent 400 and the combustible equivalent material currently contemplated for the bottom plug 320 (both reagent 400 and plug 320 are components of the Main Embodiment). The diameter of the reagent plug 700 is slightly larger than the inner diameter of the annular rings 680, trapping the reagent plug 700 from moving after it has been inserted into the cylinder 660. This interference also provides a seal, thus requiring the plug 700 to be substantially cylindrical in geometry.

The 2nd cylinder 660 further comprises an integrated First Membrane 720 that is offset from the 2nd first end 620 along the longitudinal axis of the cylinder. This offset is made sufficient such that the first membrane 720 utilizes the longitudinal portion of the 2nd cylinder 660 above it as a protective guard, preventing any accidental user contact with the first membrane 720. The first membrane 720 is integral to the 2nd cylinder 660 such that it completely joins the interior walls of the 2nd cylinder 660 in a contiguous and sealing manner.

A Barrier 740, also integral to the cylinder 660, is offset from the first membrane 720 towards the 2nd second end 640. Both barrier 740 and first membrane 720 create a 2nd first reservoir 760 inside the cylinder that is located substantially closer to 2nd first end 620 than the 2nd second end 640. This barrier 740, being made integral to the cylinder 660, completely seals the interior walls of the 2nd cylinder 660. The barrier 740 comprises of a Hole Feature 780. This hole feature 780 is necessary so as to permit introducing first reagent 400 into the $2^{nd}$ first reservoir 760. When this introduction is complete, the hole is then plugged with a Plug 800 whose compressible nature and whose diameter being larger than the hole 780 both result in a seal.

It is currently contemplated that the 2nd cylinder 660 is manufactured using some form of pressure molding process, loss wax process, or processes that include an arrangement of dies and slides. When using the injection molding process, the first reservoir—although impossible to be die cast because of its die lock condition—is formed using a Gas Assist Injection Molding process. This processes employs a Gas Assist Slide whose nozzle end is introduced into the hole feature 780 and Nitrogen gas under pressure is introduced into the $2^{nd}$ first reservoir 760, forming both the first membrane 720 and the barrier 740 simultaneously. The hole feature 780 is left behind where the nozzle had inserted through the barrier 740 but has now retracted post manufacturing.

The integrated annular ring 680 currently shown in the current One-Way configuration is in die-lock condition, preventing a die to form such feature if the main die angle travels in the same direction as the longitudinal axis of the $2^{nd}$ cylinder 660. This is readily solved with Annular Ring Slides that collapses radially into the center of the cylinder where the gas assist slide had previously occupied but has now fully retracted after fulfilling its purpose.

The advent of 3 Dimensional (3D) Printing—a manufacturing process that can form features normally not feasible due to their die lock conditions—also makes the integration of die-lock features such as $2^{nd}$ first reservoir 760 and annular ring 680 possible. This integration process becomes increasingly easier and cheaper as newly evolving manufacturing process emerges and the current ones such as 3D printing parts mature. The 3D printing process can permit the annular ring 680 to have a more acute angle inside the $2^{nd}$ cylinder 660, an acuteness that may be currently restricted by the slide technology in pressure forming molding. This acuteness provides more aggressive retention of reagent plug 700 from moving.

As described above, the first reagent 400 is injected into the $2^{nd}$ first reservoir 760 through the hole feature 760 until it is sufficiently full. The Plug 800 of compressible nature, as well as being inert to both reagent 400 and reagent plug 700, is then inserted to plug up this hole. The reagent plug 700 is inserted into the cylinder from the $2^{nd}$ second end 640 until it is sufficiently adjacent to the barrier 740. The plurality of the annular ring 680 embraces the reagent plug 700 in a continuously embracing manner that prohibits the plug from retreating from its inserted position, while providing a leak free seal.

Operations—FIG. 5:

The user simply has to insert his finger or similar non piercing apparatus into the $2^{nd}$ first end 620 of $2^{nd}$ cylinder 660 until he contacts first membrane 720. Upon contact, the user then simply depresses the first membrane 720 until he feels the membrane resistance to his pushing suddenly drop. This drop corresponds to the dislodging of plug 800, which then causes the first reagent 400 to evacuate from the $2^{nd}$ first reservoir 760 under pressure.

An immediate but controlled exothermic reaction starts when first reagent 400 contacts reagent plug 700.

The user then places this exothermic reaction at a user defined location for the combustion to fully actualize.

Illustration of the Subject Technology as Clauses

Some example aspects of the subject technology may be represented as clauses. These clauses are examples of the subject technology, and do not limit the subject technology.

1. A disposable fire-starting apparatus comprising:
   a housing 660 (260) configured to have:
      a first end 620 (220) and a second end 640 (240),
      a storage cell 760 (340),
      an initiation region 690 (360),
      an annular ring 680 (280),
   a first reagent 400,
   a second reagent 700 (460),
   a removable barrier 800 (420) interposed between the at least first reagent and the at least second reagent in a selective manner,
   Wherein the at least first reagent 400 is housed in the storage cell 760 (340); wherein the annular ring prevents the at least second reagent 700 (460) in the initiation region 690 (360) from moving; wherein the initiation region 690 (360) houses the at least a second reagent 700 (460) adjacent to the at least first reagent 400; wherein both the storage cell 760 (340) and initiation region 690 (360) are in continuous communication with each other in a selective and thermal communicative way; whereby upon user's urging, the removable barrier 800 (420) is removed from its interposed position and the at least first reagent 400 evacuates from the storage cell 760 (340) into the initiation region 690 (360), bringing the at least first reagent 400 into contact with the at least a second reagent 700 (460), resulting in a contact that causes both the at least reagents to undergo a spontaneous exothermic chemical reaction thereby initiating said exothermic chemical reaction of said reagents.
2. The apparatus of clause 1, wherein the annular ring 680 circumscribes the interior wall of the housing 660 in a sealable manner, wherein the annular ring 680 embraces the second reagent 700 in a continuously embracing and sealing manner.
3. The apparatus of clause 1 wherein the storage cell 760 comprises a first and second wall, wherein the first wall of the storage cell 760 is defined by a malleable membrane 720 that fully circumscribes and joins the interior wall of the housing 660 in a sealing manner, and wherein the membrane 720 is sufficiently offset from the first end 620 whereby to prevent unintended user contact with malleable membrane 720.
4. The apparatus of clause 3, wherein the second wall of the storage cell 760 is defined by a non-movable barrier 740 comprising a hole feature 780, wherein the non-movable barrier 740 fully circumscribes the interior wall of the housing 660 in a sealing manner, and whereby the storage cell 760 completely houses the first reagent 400 in a selectively sealable manner when used in conjunction with the removable barrier 800 and with the interior wall of the housing 660.
5. The apparatus of clause 4 wherein the malleable membrane 720 and the removable barrier 800 is in continuous communication with each other.
6. The apparatus of clause 1 wherein the first reagent 400 is a compound selected from a group comprising of ethanol, isopropanol, ethylene glycol and polyethylene glycol.
7. The apparatus of clause 1 wherein the second reagent 700 is a compound selected from a group comprising of potassium permanganate, manganese oxide, potassium chlorate, barium peroxide and potassium nitrate.
8. The apparatus of clause 7 wherein the second reagent 700 is admixed with a combustible material to form a plug.
9. The apparatus of clause 8 wherein the second reagent 700 has a shape that is slightly larger than the interior diameter of the annular ring 680 so as to whereby achieve a seal that prevents the second reagent 700 from moving within the housing 660 and that prevents any first reagent 400 leaks while in the initiation region.
10. The apparatus of clause 1 wherein the removable barrier 420 comprises of a contiguous membrane that fully encapsulates the first reagent 400 in a fully sealable manner.
11. The apparatus of clause 10 wherein the housing terminates with the annular ring 280 at the first end and a second annular ring 280 at the second end.
12. The apparatus of clause 11 further comprising a first plug 300 made from a combustible material, wherein the plug 300 substantially conforms to the interior walls of the housing, wherein the external size of the plug exceeds the inside size of the annular ring 280, wherein the plug 300 is interposed between the annular ring 280 and the first reagent 400, whereby the first reagent 400 is trapped from exiting the first end of the housing 220 by the first plug 300.

13. The apparatus of clause 12 wherein the second reagent 440 is a plug that is interposed between the first reagent 400 and the second annular ring 280 at the second end.
14. The apparatus of clause 13 wherein the first plug 300 comprises of a tunnel feature that permits access to the first reagent 400.
15. The apparatus of clause 14 further comprising of a piercing member 480 with an urging end 500 and a piercing end 520, Wherein a user urges the piercing member 480 into the tunnel feature, and selectively removes the contiguous membrane 420 of the at least first reagent by urging the piercing member 480 using the urging end 500 to pierce the contiguous membrane 420 with the piercing end 520 of the piercing member 480, whereby bringing the at least first reagent 400 into contact with the at least second reagent 440, a contact that causes both the at least reagents to undergo a spontaneous exothermic chemical reaction, thereby initiating said exothermic chemical reaction of said reagents and said plugs.

16. The apparatus of clause 15 wherein the first reagent 400 is a compound selected from a group comprising of ethanol, isopropanol, ethylene glycol and polyethylene glycol.
17. The apparatus of clause 16 wherein the second reagent 440 is a compound selected from a group comprising of potassium permanganate, manganese oxide, potassium chlorate, barium peroxide and potassium nitrate.
18. The apparatus of clause 17 further comprising a second plug 320 made from a combustible material, wherein the plug 320 substantially conforms to the interior walls of the housing 260, wherein the external size of the plug 320 exceeds the inside size of the annular ring 280, wherein the plug 320 is interposed between the second annular ring 280 and the second reagent 440, whereby the second reagent 440 is trapped from exiting the second end 240 of the housing by the second plug 320.
19. The apparatus of clause 18 further comprises a second removable barrier, wherein the second removable barrier comprises of a second contiguous membrane 460 that fully encapsulates the second reagent 440 in a fully sealable manner.
20. The apparatus of clause 19 wherein a user urges the piercing member 480 into the tunnel feature, and selectively removes both the contiguous membrane 420 and second contiguous membrane 460 by urging the piercing member 480 via the urging end 500 to pierce both membranes with the piercing end 520 of the piercing member, whereby bringing the at least first reagent 400 into contact with the at least second reagent 440, a contact that causes both the at least reagents to undergo a spontaneous exothermic chemical reaction, thereby initiating said exothermic chemical reaction of said reagents and said plugs.

What is claimed is:

1. A disposable fire-starting apparatus comprising:

a housing configured to have:
- a first end and a second end,
- a storage cell,
- an initiation region,
- an annular ring, a first reagent, a second reagent, a removable barrier interposed between the storage cell and the initiation region in a selective manner, Wherein the at least first reagent is housed in the storage cell situated longitudinally away from the first end in an offset manner that defines a depression within the housing; wherein the annular ring prevents the at least second reagent in the initiation region from moving; wherein the initiation region houses the at least a second reagent adjacent to the at least first reagent; wherein both the storage cell and initiation region are in continuous communication with each other in a selective and thermal communicative way; whereby upon user's urging, the barrier is removed from its interposed position and the at least first reagent evacuates from the storage cell into the initiation region, bringing the at least first reagent into contact with the at least second reagent, resulting in a contact that causes both the at least reagents to undergo a spontaneous exothermic chemical reaction thereby initiating said exothermic chemical reaction of said reagents; wherein the chemical reaction relies on the depression to prevent unintentional activation; wherein the urging causes the first reagent to increase pressure against the removable barrier that further causes the removable barrier to move from its interposed position.

2. The apparatus of claim 1, wherein the annular ring circumscribes the interior wall of the housing in a sealable manner, wherein the annular ring embraces the second reagent in a continuously embracing and sealing manner.

3. The apparatus of claim 1 wherein the storage cell comprises a first and second wall, wherein the first wall of the storage cell is defined by a malleable membrane that fully circumscribes and joins the interior wall of the housing in a sealing manner, and wherein the membrane is sufficiently offset from the first end whereby to prevent unintended user contact with malleable membrane.

4. The apparatus of claim 3, wherein the second wall of the storage cell is defined by a non-movable barrier comprising a hole feature, wherein the non-movable barrier fully circumscribes the interior wall of the housing in a sealing manner, and whereby the storage cell completely houses the first reagent in a selectively sealable manner when used in conjunction with the removable barrier and with the interior wall of the housing.

5. The apparatus of claim 4 wherein the malleable membrane and the removable barrier are in continuous communication with each other.

6. The apparatus of claim 1 wherein the first reagent is a compound selected from a group comprising of ethanol, isopropanol, ethylene glycol and polyethylene glycol.

7. The apparatus of claim 1 wherein the second reagent is a compound selected from a group comprising of potassium permanganate, manganese oxide, potassium chlorate, barium peroxide and potassium nitrate.

8. The apparatus of claim 7 wherein the second reagent is admixed with a combustible material to form a plug.

9. The apparatus of claim 8 wherein the second reagent has a shape that is slightly larger than the interior diameter of the annular ring so as to whereby achieve a seal that prevents the second reagent from moving within the housing and that prevents any first reagent leaks while in the initiation region.

10. The apparatus of claim 1 wherein the removable barrier comprises of a contiguous membrane that fully encapsulates the first reagent in a fully sealable manner.

11. The apparatus of claim 10 wherein the housing terminates with the annular ring at the first end and a second annular ring at the second end.

12. The apparatus of claim 11 further comprising a first plug made from a combustible material, wherein the first plug substantially conforms to the interior walls of the housing, wherein the external size of the first plug exceeds the inside size of the annular ring, wherein the first plug is interposed between the annular ring and the first reagent, whereby the first reagent is trapped from exiting the first end of the housing by the first plug.

13. The apparatus of claim 12 wherein the second reagent is a plug that is interposed between the first reagent and the second annular ring at the second end.

14. The apparatus of claim 13 wherein the first plug comprises of a tunnel feature that permits access to the first reagent.

15. The apparatus of claim 14 further comprising of a piercing member with an urging end and a piercing end, Whereby upon urging the piercing member into the tunnel feature, the piercing end of the piercing member pierces the contiguous membrane of the at least first reagent, whereby bringing the at least first reagent into contact with the at least second reagent, a contact that causes both the at least first and second reagents to undergo a spontaneous exothermic chemical reaction, thereby initiating said exothermic chemical reaction of said reagents and said plug; wherein the depression comprises of the tunnel feature.

16. The apparatus of claim 15 wherein the first reagent is a compound selected from a group comprising of ethanol, isopropanol, ethylene glycol and polyethylene glycol.

17. The apparatus of claim 16 wherein the second reagent is a compound selected from a group comprising of potassium permanganate, manganese oxide, potassium chlorate, barium peroxide and potassium nitrate.

18. The apparatus of claim 17 further comprising a second plug made from a combustible material, wherein the plug substantially conforms to the interior walls of the housing, wherein the external size of the plug exceeds the inside size of the annular ring, wherein the plug is interposed between the second annular ring and the second reagent, whereby the second reagent is trapped from exiting the second end of the housing by the second plug.

19. The apparatus of claim 18 further comprises a second removable barrier, wherein the second removable barrier comprises of a second contiguous membrane that fully encapsulates the second reagent in a fully sealable manner.

20. The apparatus of claim 19 whereby upon urging the piercing member into the tunnel feature, the piercing end of the piercing member pierces the contiguous membrane of the at least first reagent and the contiguous membrane of the at least second reagent, whereby bringing the at least first reagent into contact with the at least second reagent, whereby the contact that causes both the at least first and second reagents to undergo a spontaneous exothermic chemical reaction, thereby initiating said exothermic chemical reaction of said reagents and said plugs.

* * * * *